US006034856A

United States Patent [19]

Kather et al.

[11] Patent Number: 6,034,856

[45] Date of Patent: Mar. 7, 2000

[54] METHOD OF RECOGNIZING WHETHER AN ARMATURE IS IN CONTACT WITH AN ELECTROMAGNETIC ACTUATOR

[75] Inventors: Lutz Kather, Würselen; Martin Puschinger; Günter Schmitz, both of Aachen, all of Germany

[73] Assignee: Fev Motorentechnik GmbH & Co KG, Aachen, Germany

[21] Appl. No.: 09/126,841

[22] Filed: Jul. 31, 1998

[30] Foreign Application Priority Data

Jul. 31, 1997 [DE] Germany ..... 197 33 138

[51] Int. Cl.[7] ..... H02H 3/00

[52] U.S. Cl. ..... 361/87; 361/18; 361/115

[58] Field of Search ..... 361/23, 24, 25, 361/18, 115, 93, 100, 87

[56] References Cited

U.S. PATENT DOCUMENTS 5,691,680 11/1997 Schrey et al. ..... 335/256

5,791,305 8/1998 Kather ..... 123/90.11

FOREIGN PATENT DOCUMENTS

3024109C2 1/1982 Germany .

*Primary Examiner*—Stephen W. Jackson

*Attorney, Agent, or Firm*—Venable; George H. Spencer; Norman N. Kunitz

[57] ABSTRACT

A method of recognizing the contact of an armature in an electromagnetic actuator for activating a setting member that can be brought out of a first set position, counter to the force of a restoring spring, and brought into contact with the pole surface of the electromagnet and held when the electromagnet is supplied with current. The controlled (clocked) current course for the holding phase is detected during the time provided for armature contact, and is converted into a current-proportional voltage, and the converted voltage is differentiated and detected as a recognition signal, both for the normal condition of "armature in contact" and the fault condition of "armature is not in contact."

2 Claims, 2 Drawing Sheets

METHOD OF RECOGNIZING WHETHER AN ARMATURE IS IN CONTACT WITH AN ELECTROMAGNETIC ACTUATOR

REFERENCE TO RELATED APPLICATIONS

This application claims the priority of German Application Serial No. DE 197 33 138.6, filed Jul. 31, 1997 which is incorporated herein by reference.

BACKGROUND OF THE INVENTION

The present invention relates to electromagnetically-actuatable actuators which have at least one electromagnet and an armature that acts on a device to be set or controlled, with the armature being connected to at least one restoring arrangement so the armature can be moved, by the switching on of the coil current of the electromagnet, from a first set position that is predetermined by the restoring arrangement into a second set position defined by the contact of the armature with the electromagnet. Electromagnetically-actuatuble actuators are used, for example, to control cylinder valves in reciprocating engines. In this instance, two electromagnets are provided, between which the armature can be moved, counter to the force of a restoring arrangement, through the cutoff of the coil current at the holding electromagnet and the switching on of the coil current at the capturing electromagnet, respectively. With corresponding actuation of the individual actuators of the individual cylinder valves, the work medium can flow in and out, so the work process can be optimally influenced with respect to the necessary considerations. The procedure of the control has a great influence on the different parameters, such as the states of the work medium in the inlet region, the work chamber, e.g., a combustion chamber, and the outlet region, as well as on the processes in the work chamber itself. Because reciprocating engines operate unsteadily, that is, under widely-varying operating conditions, a corresponding, adaptable control of the cylinder valves is necessary. Electromagnetically-actuatable setting arrangements for cylinder valves are known from, for example, DE-C-3 024 109, corresponding to U.S. Pat. No. 4,455,543 which is incorporated herein by reference, such setting arrangements permit a completely-variable adaptation of the opening and closing times.

A significant problem in controlling such electromagnetically-actuatable setting arrangements is timing precision, which is necessary particularly in the control of the engine power for the intake valves. Precise control of the times is impeded by manufacturing-stipulated tolerances, the occurrence of wear in operation, and different operating states, for example, fluctuating operating frequencies, because these external influences can also impact the time-relevant system parameters.

One approach to attaining high control precision involves the application of a comparatively high energy for capturing the armature at a respective magnet pole surface. However, this high energy expenditure is associated with a reduced operating reliability, because the further problem of so-called armature bouncing occurs to a greater extent. This problem occurs because the armature impacts the pole surface at a high speed and bounces away from it immediately or shortly thereafter. In cylinder valves, for example, this bouncing negatively influences the operation of the engine. In order to save energy, when the armature lies against the magnet pole surface, the supply of the current to electromagnet is reduced to the amount necessary to hold the armature, and the current supply is clocked between an upper and a lower level for further savings. It is also important that the armature actually be held against the magnet pole surface.

It is the object of the invention to provide a method that permits flawless recognition of whether the armature lies against the electromagnet pole surface, for example, for diagnostic purposes.

SUMMARY OF THE INVENTION

The above object generally is achieved in accordance with the method of the invention, in that the controlled (clocked) current course for the holding phase is detected during the time provided for armature contact, and is converted into a current-proportional voltage, and the converted voltage is differentiated and detected as a recognition signal for both the normal or desired condition of "armature in contact" and the fault condition of "armature not in contact."

An advantageous feature of this method is that, in the holding phase for the armature, the electromagnet is acted upon by a clocked holding current via the control device. In other words, the holding current is cut off when an upper current level is attained and, after dropping, is switched on again when a lower, predetermined current level is attained. As a result and with an inductance that is assumed to be linear, rising and falling e-function segments and their frequency are produced.

The distance between the armature and the pole surface also influences the weighting of the losses in the magnetic circuit and the dependency of the inductance on the current flowing through, so that different current curves result for the positions of "armature in contact" and "armature not in contact."

Under the fault condition of "armature not in contact," and at a current level lower than 1.5 A, a linear inductance can be assumed with sufficient precision. Thus, short e-function segments result, which are to be assumed as rising and falling straight segments in a first approximation.

Under the normal condition of "armature in contact," increased eddy losses and iron losses occur in the system. These losses particularly distinguish the time period immediately following the switching of the regulator, that is, the change in operational sign of the current increase. This leads to a substantial change in the current directly after the switching, which change slowly decays, so a course that is characteristic per se results here.

The characteristic of the design of the magnetic circuit here does not result in a sufficiently-perceptible change in the differential inductance as a function of the armature contact. To be able to clearly recognize the characteristic differences around the switching time, the detected current is converted into a current-proportional voltage, and the converted voltage is differentiated. Under the fault condition of "armature not in contact," a square-wave voltage results, while a characteristic peak that clearly illustrates the normal condition of "armature in contact" results for the normal condition. To detect the peak, a threshold is advisably established and a valid signal is emitted when the threshold is exceeded. This threshold need not be predetermined with control in the method of the invention, however. It can be obtained from the differentiated voltage by means of a low-cost and simple circuit, so the influence of other parameters can be avoided. In addition, the average value of the positive, differentiated voltage is formed, and the threshold is established with a factor of K×average value, with K<1.

In the realization of the diagnostic method of the invention, the converted voltage proportional to the coil current is amplified to a signal level of about 5 Volts. The current-proportional voltage is now differentiated, and the obtained signal is transmitted, via a sampling circuit and an analog switch that is closed synchronously with the increasing current segment, to an RC low-pass filter, then enhanced as a comparison threshold and guided in parallel via an amplifier stage with V<1. The enhanced signals are compared in a comparator.

In the case of a square-wave voltage, the peak voltage of the square-wave signal results as the comparison threshold. The signal amplified with V<1 is thus always smaller than the comparison threshold. Hence, the comparator always supplies a high level as the output signal. When the armature is in contact, the signal is both above and below the average value. If the switch-on time of the analog switch is delayed by the time period of the characteristic peak of the differentiated voltage, it is ensured that this peak is always greater than the average value. In the holding phase, when the armature is in contact, the comparator generates a pulse sequence that travels to a re-triggerable monoflop whose time constant amounts to at least one period of the clock frequency. The monoflop output is linked to a corresponding logic with capturing and holding signals.

The invention is explained in detail in conjunction with schematic diagram drawing figures.

DETAILED DESCRIPTION OF THE PREFERRED EMBODIMENTS

Figure 1:
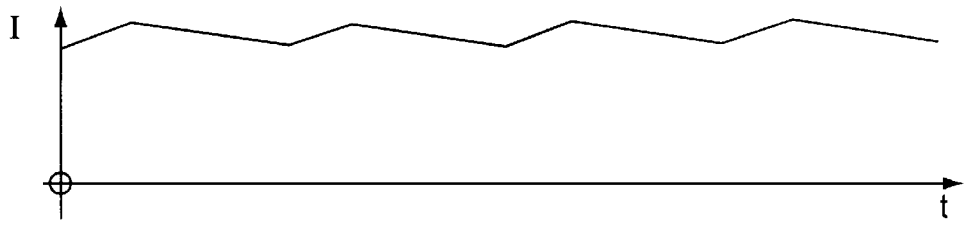
FIG. 1 shows the course of the coil current in the clocked holding phase for the case of "armature not in contact."

FIG. 1 shows the course of the coil current through the coil of the electromagnet of an electromagnetic actuator of the type mentioned at the outset, for the case in which the armature does not rest against the pole surface of the electromagnet. It can be seen here that, as described above, the individually rising and falling segments of the current-course curve are represented with sufficient precision by straight segments.

Figure 3:
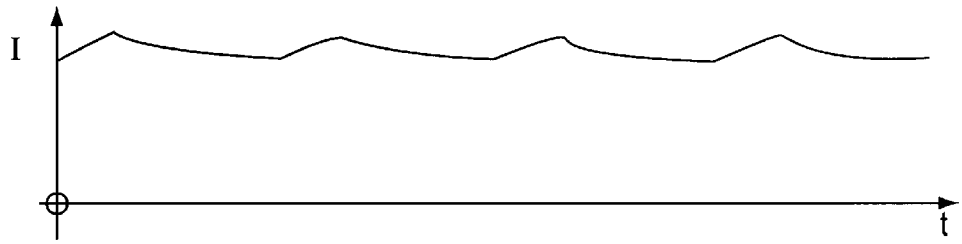
FIG. 3 shows the course of the current during the holding phase for the case of "armature in contact"."

If this course is compared to the current course according to FIG. 3, where an armature rests against the pole surface of the electromagnet, it can be seen that in FIG. 3 the result is a sequence of rising and falling e-function segments caused by the greater eddy current losses and iron losses occurring in the system due to the armature, rather that the straight line segments of FIG. 1.

Despite the distinct differences, however, a corresponding recognition signal cannot be derived from the course that is characteristic per se for the normal condition of "armature in contact"."

Figure 2:
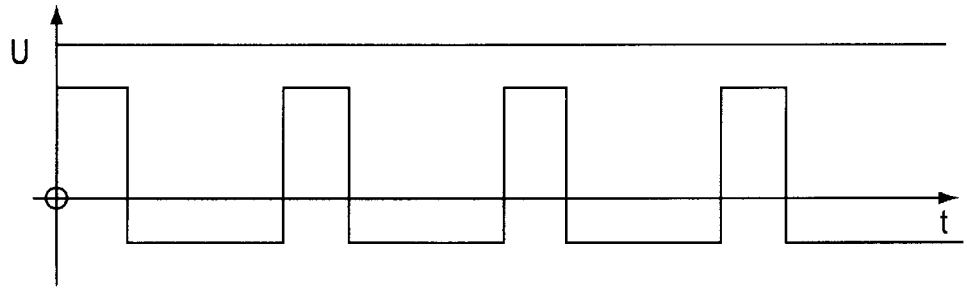
FIG. 2 shows the voltage course obtained through the differentiation of the current course according to FIG. 1.

If, according to the method of the invention, the coil current shown in FIG. 1 is now converted, proportional to the current, into a voltage and differentiated, the rectangular course illustrated in FIG. 2 results for the fault condition of "armature not in contact" illustrated in FIG. 1.

Figure 4:
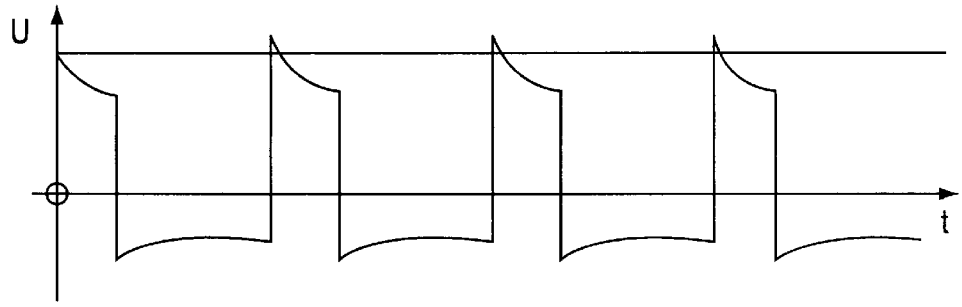
FIG. 4 shows the voltage course obtained through the differentiation of the coil current according to FIG. 3.

The course or curve shown in FIG. 4 results if the same measures are implemented for the current course of the normal condition of "armature in contact"" illustrated in FIG. 3. However, this course of FIG. 4 has distinct peaks for the upper rectangle edge when the current is switched on, and for the lower rectangle edge when the current is cut off. With a corresponding signal enhancement with the circuit shown in FIG. 5, it can be shown that no signal is applied or provided for the fault condition, because a predetermined average value is not exceeded, whereas under the normal condition, as can be seen in FIG. 4, the predetermined average value for the current switch-on time is clearly exceeded.

Figure 5:
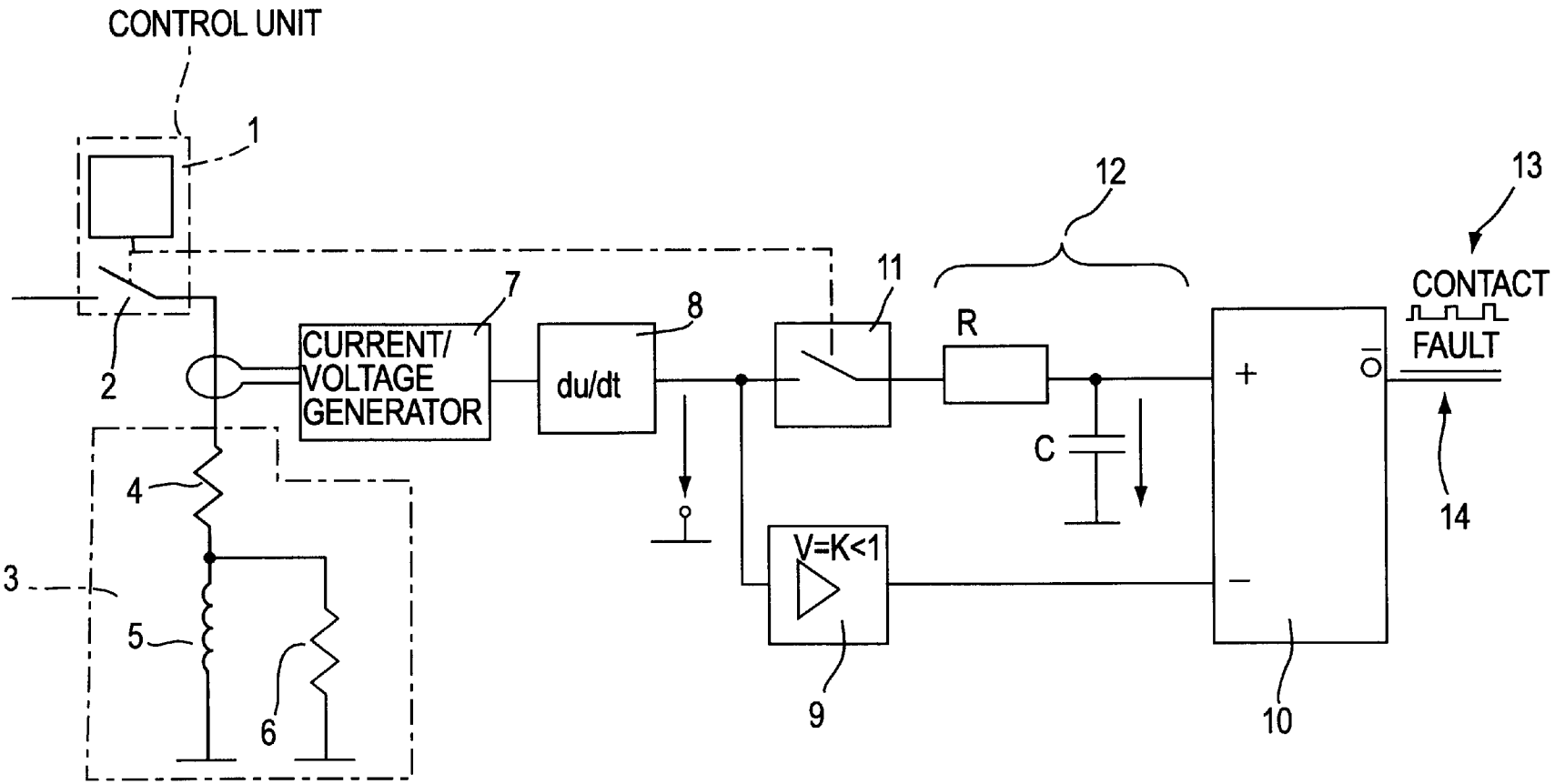
FIG. 5 shows a block diagram of a circuit according to the invention for recognizing contact of the armature.

FIG. 5 illustrates an embodiment for an evaluation circuit. By way of a clock end stage 1 of a control device, an electromagnet 3 is supplied with current in a clocked manner with the aid of a switch 2 that is actuated, in a known manner, by the control device 1 such that the current is switched on, starting at a low level for the electromagnet holding current. As soon as the current has attained a predetermined, upper level for the holding current, the current supply is cut off again, so the current drops correspondingly and is not switched on again until the lower level for the holding current has been reached. This clocking is effected during the entire holding time predetermined by the control device 1, during which time the electromagnet armature (not shown) is to be held against the pole surface of the electromagnet 3. In the block diagram, the electromagnet 3 is indicated by the resistor 4 of the copper winding, the inductance 5 of the winding and the resistor 6, which represents the eddy current losses and the iron losses that occur as a function of whether the armature rests against the electromagnet (normal condition) or not (fault condition).

A current-proportional voltage is generated from the current supplied to the electromagnet 3 by a current-voltage transformer 7 and differentiated in a differentiator 8. To form an average value, the output of the differentiator 8 is amplified by a weighting factor or constant <1 in an amplifier 9, and this average value is supplied to one input of a comparator 10.

The signal emitted by the differentiator 8 is transmitted, via an analog switch 11 that is closed synchronously with the rising current segment, to an RC low-pass filter 12, and then is likewise conducted to the comparator 10. Through a comparison of the two signals supplied to the comparator 10, the comparator generates a pulse sequence 13 in the holding phase, with an armature resting against the pole face, and the comparator generates a signal 14 "0" when the armature is not in contact with the pole face of the electromagnet 3. As described above, the pulse sequence is supplied to a re-triggerable monoflop whose time constant amounts to at least one period of the clock frequency. The output of the monoflop, not shown here, is linked to a corresponding logic for capturing and holding signals.

The invention now fully being described, it will be apparent to one of ordinary skill in the art that many changes and modifications can be made thereto without departing form the spirit or scope of the invention as set forth herein.

What is claimed is:

1. A method of recognizing the contact of an armature against a pole face in an electromagnetic actuator for activating a setting member, with the actuator having at least one electromagnet, which is supplied with a clocked current by a control device, and whose armature is in operational connection with the setting member and can be brought out of a first set position, counter to the force of a restoring spring, and brought into contact with the pole face of the electromagnet and held when the electromagnet is supplied with current, said method comprising detecting the controlled (clocked) current course for the holding phase during the time provided for armature contact; converting the detected current into a current-proportional voltage; differentiating the converted current-proportional voltage; and detecting the differentiated converted voltage as a recognition signal, both for the normal condition of "armature in contact" and the fault condition of "armature not in contact."

2. The method as defined in claim 1, wherein the step of detecting the differentiated converted voltage comprises:

forming an average value of the positive portion of the differentiated voltage to amplify the characteristic deviations in the current course between the normal condition and the fault condition,; establishing a threshold value by multiplication of the amplified positive portion by a constant K<1; and, comparing the threshold value to the voltage signal obtained from the differentiation to derive a recognition signal of the position of the armature.

* * * * *